US006209869B1

(12) United States Patent
Mathews

(10) Patent No.: US 6,209,869 B1
(45) Date of Patent: Apr. 3, 2001

(54) METHOD AND APPARATUS FOR ROULETTE-TYPE GAMES

(75) Inventor: Marc Mathews, 4263 Jasper Dr., Chandler, AZ (US) 85226

(73) Assignees: Marc Mathews; Melissa Mathews, both of Tempe, AZ (US)

( * ) Notice: Subject to any disclaimer, the term of this patent is extended or adjusted under 35 U.S.C. 154(b) by 0 days.

(21) Appl. No.: 09/316,615

(22) Filed: May 21, 1999

Related U.S. Application Data

(60) Provisional application No. 60/086,859, filed on May 27, 1998.

(51) Int. Cl.[7] ..... A63F 5/00

(52) U.S. Cl. ..... 273/138.1; 273/274; 273/309; 273/142 E; 273/142 R

(58) Field of Search ..... 273/142 R, 142 E, 273/142 D, 142 H, 142 HA, 142 J, 142 JA, 142 JB, 142 JC, 142 JD, 142 K, 274, 138.1, 138.2, 309; 463/17

(56) References Cited

U.S. PATENT DOCUMENTS 5,102,135 4/1992 Addiechi ..... 273/142 E
5,553,851 9/1996 Malavazos et al. ..... 273/142 E
5,636,838 6/1997 Caro ..... 273/142 E
5,755,440 5/1998 Sher ..... 273/142 E

FOREIGN PATENT DOCUMENTS

1113668 * 5/1968 (GB) ..... 273/274

* cited by examiner

*Primary Examiner*—Benjamin H. Layno
(74) *Attorney, Agent, or Firm*—Koley Jessen P.C. A Limited Liability Organization; Mark D. Frederiksen

(57) ABSTRACT

A roulette game includes a conventional roulette wheel modified to include a plurality of tracks, to receive the simultaneous play of a plurality of balls. A plurality of independent tables are then provided extending from the roulette wheel, each table associated with one of the plurality of balls on the wheel. Each table includes one playing field for placing bets on a single ball of the plurality, and a second playing field for placing bets relative to the plurality of balls. In the method of playing the roulette game, a player places a bet as to the pocket or pockets on the wheel in which the plurality of balls will be located at the outcome of a spin. The roulette wheel is then rotated in a first direction, and a plurality of balls are propelled in the opposite direction along tracks in the roulette wheel. The pockets in which each of the balls falls during a spin is identified, and winning and losing bets are then determined.

9 Claims, 3 Drawing Sheets

METHOD AND APPARATUS FOR ROULETTE-TYPE GAMES

CROSS-REFERENCES TO RELATED APPLICATIONS

This application claims the benefit of U.S. Provisional Application Ser. No. 60/086,859, filed May 27, 1998.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to a roulette-type game, and more particularly to an improved method and apparatus for playing such a game, utilizing a plurality of balls.

(2) Background Information

Gambling and games of chance are popular sources of entertainment for many people. Such games of chance are more enjoyable if a variety of different gaming apparatus are available to the player. New forms of gaming apparatus and new methods of playing existing games can generate new interests and enthusiasm in this activity.

One game that has been popular through the years is the game of roulette. In this game, a single rolling ball is propelled around a generally circular track in a direction opposite the rotation of a central wheel. Wagers are placed on the likelihood of the ball landing in a particular pocket or cassette formed around the perimeter of the central wheel.

While roulette has been a gaming apparatus present in casinos for many years, it has been becoming less popular in the recent past. While many reasons have been given for this reduction in popularity, today's gamblers have found conventional roulette to be "boring" and "too predictable" a game.

BRIEF SUMMARY OF THE INVENTION

It is therefore a general object of the present invention to provide an improved method and apparatus for playing a roulette-type game.

Another object is to provide an improved roulette gaming apparatus which permits the simultaneous play of a plurality of balls, and permits all of the balls to be deposited within a single pocket or cassette.

A further object of the present invention is to provide a method for playing a roulette type game, which permits betting on the number of balls which may simultaneously fall within a single pocket, or within a specified group of pockets.

Yet another object is to provide a method and apparatus for playing an improved roulette-type game, which permits play at several tables simultaneously on a single game.

These and other objects will be apparent to those skilled in the art.

The roulette game of the present invention includes a conventional roulette wheel modified to include a plurality of tracks, to receive the simultaneous play of a plurality of balls. A plurality of independent tables are then provided extending from the roulette wheel, each table associated with one of the plurality of balls on the wheel. Each table includes one playing field for placing bets on a single ball of the plurality, and a second playing field for placing bets relative to the plurality of balls. In the method of playing the roulette game, a player places a bet as to the pocket or pockets on the wheel in which the plurality of balls will be located at the outcome of a spin. The roulette wheel is then rotated in a first direction, and a plurality of balls are propelled in the opposite direction along tracks in the roulette wheel. The pockets in which each of the balls falls during a spin is identified, and winning and losing bets are then determined.

BRIEF DESCRIPTION OF THE SEVERAL VIEWS OF THE DRAWING

The preferred embodiment of the present invention is illustrated in the accompanying drawings, in which similar or corresponding parts are identified with the same reference numeral throughout the several views, and in which.

DETAILED DESCRIPTION OF THE INVENTION

Figure 1:
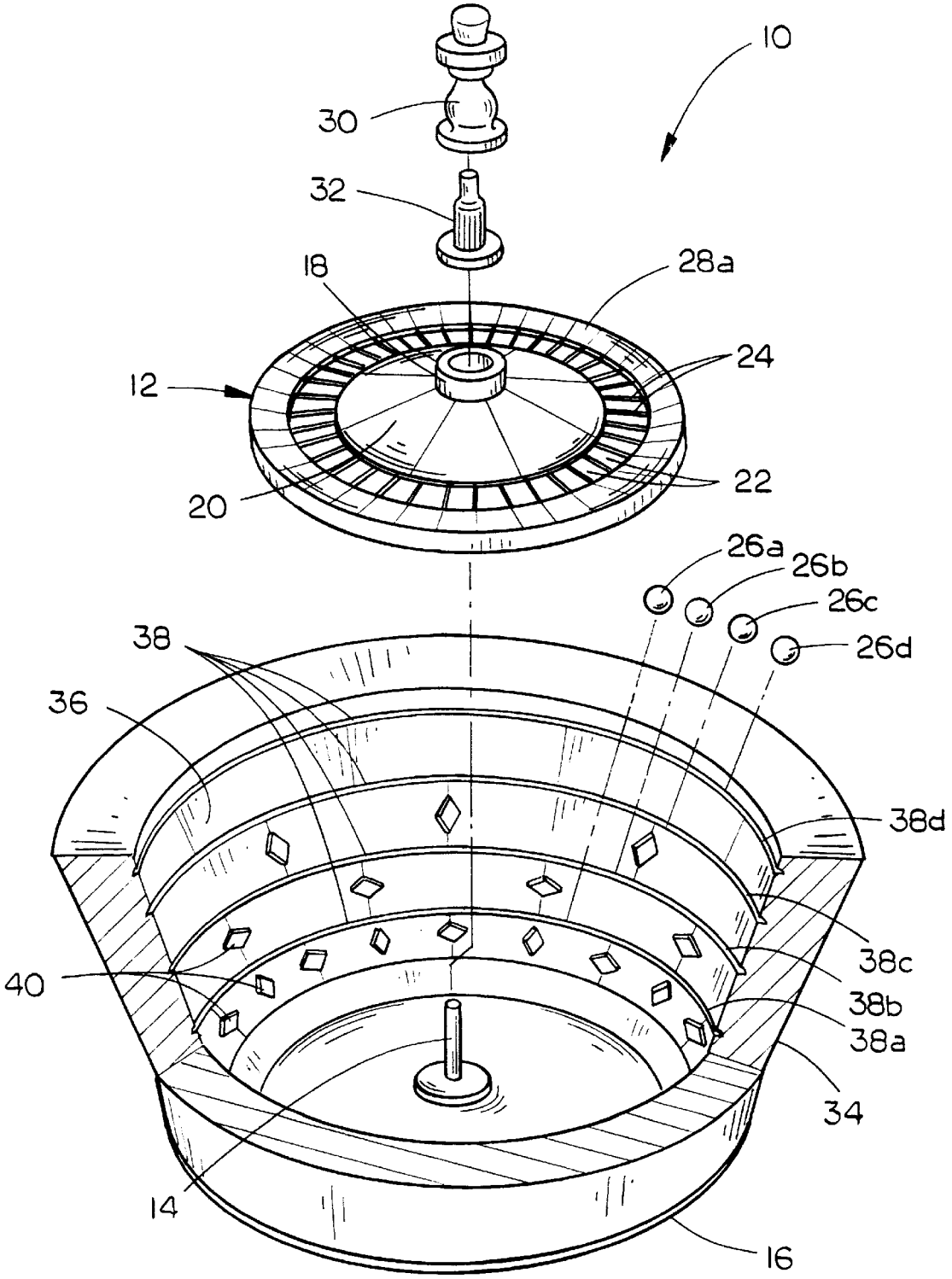
FIG. 1 is an exploded perspective view of the improved roulette wheel of the present invention, with portions shown in section.

Referring now to the drawings, and more particularly to FIG. 1, the improved roulette wheel of the present invention is designated generally at 10 and includes a disk 12 rotatably mounted on a shaft 14 projecting upwardly from a support base 16.

Disk 12 includes a central bearing housing 18 which rotatably connects the disk to shaft 14. A cone-shaped surface 20 extends radially outwardly and slopes downwardly from housing 18. Disk 12 has a plurality of pockets 22 extending radially outwardly and downwardly into the upper surface of disk 12 along the circumference of cone-shaped surface 20. Pockets 22 are separated by a plurality of radially extending frets 24, and open upwardly to receive balls 26*a*, 26*b*, 26*c*, and 26*d* therein, as described in more detail hereinbelow. An outer ring 28 extends around the circumference of pockets 24, and has a flat upper surface 28*a* upon which the numbers 00, 0, and 1–36 are printed or engraved, adjacent each of the pockets 22. The numbers may be alternatively red and black, while the zeros are usually green.

A turret 30 is connected to a height adjuster 32 and mounted on the upper end of bearing housing 18, to assist in the manual spinning of disk 12. The stationary base 16 supports the rotatable disk 12 and includes a bowl 34 extending upwardly and outwardly from a position surrounding disk 12. Bowl 34 has a steeply sloped interior face 36 with a plurality of vertically spaced concentric annular grooves 38 forming independent tracks 38*a*, 38*b*, 38*c*, and 38*d* for balls 26*a*, 26*b*, 26*c*, and 26*d*. Each track 38 is designed to receive and retain a ball 26 as the ball is propelled in a circular motion along the track, but permit each ball to fall downwardly out of the track upon loss of a predetermined amount of its velocity, to thereby spiral downwardly and into one of the pockets 22 on the spinning disk 12. A plurality of projections 40 may be formed in the land portions of the interior face 36 between tracks 38, to thereby deflect balls 26 as they fall downwardly towards the spinning disk 12.

Figure 2:
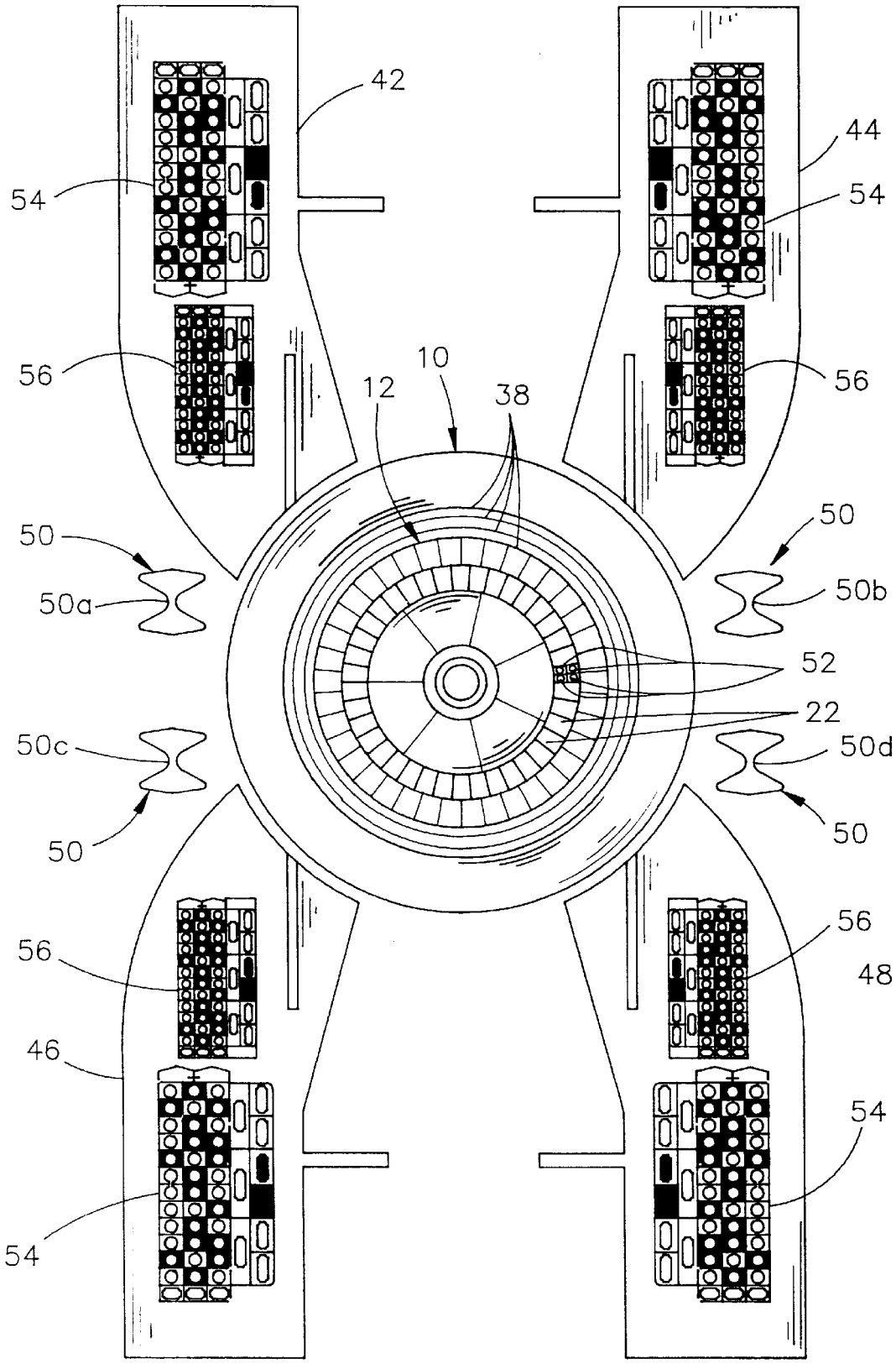
FIG. 2 is a plan view of a table configuration for the game.

Referring now to FIG. 2, a layout of the preferred embodiment of the roulette game of the present invention is shown in more detail. The roulette wheel 10 is preferably located generally centrally among four radially projecting tables 42, 44, 46, and 48. In order to associate each table with one of balls 26, it is preferred that each table have a colored top matching the color of the particular ball. Thus, in this case, table 42 is identified as a blue table and is associated with a blue colored ball 26*a*, table 44 is red and is associated with a red ball 26*b*, table 46 is purple and is associated with the purple ball 26*c*, and table 48 is green and is associated with green ball 26*d*. A vertical electronic display post 50 is provided for each table 42, 44, 46, and 48, and is located proximal the roulette wheel 10 and each table. Each post 50 has electronic display apparatus for displaying the number of the pocket within which the associated colored ball falls during play of the game. Thus, post 50*a* displays the location of blue ball 26*a*, post 50*b* shows the location of red ball 26*b*, post 50*c* shows the location of purple ball 26*c*, and post 50*d* shows the location of green ball 26*d*.

Each pocket 22 includes a plurality of sensors 52, each operable to detect one of the four balls 26*a*, 26*b*, 26*c*, and 26*d*. The sensors are shown in only one pocket in the drawings, and are well known in the art and will not be described in further detail herein. The sensors 52 are electrically connected to posts 50 to transmit information for display thereon. Posts 50 are preferably mounted to permit viewing from all four tables 42, 44, 46, and 48.

Each table 42, 44, 46, and 48 includes a lower playing field 54 and an upper playing field 56, upon which bets are placed for the roulette game. Playing fields 54 and 56 are identical on each table, and therefore only table 48 will be described in detail hereinbelow.

Figure 3:
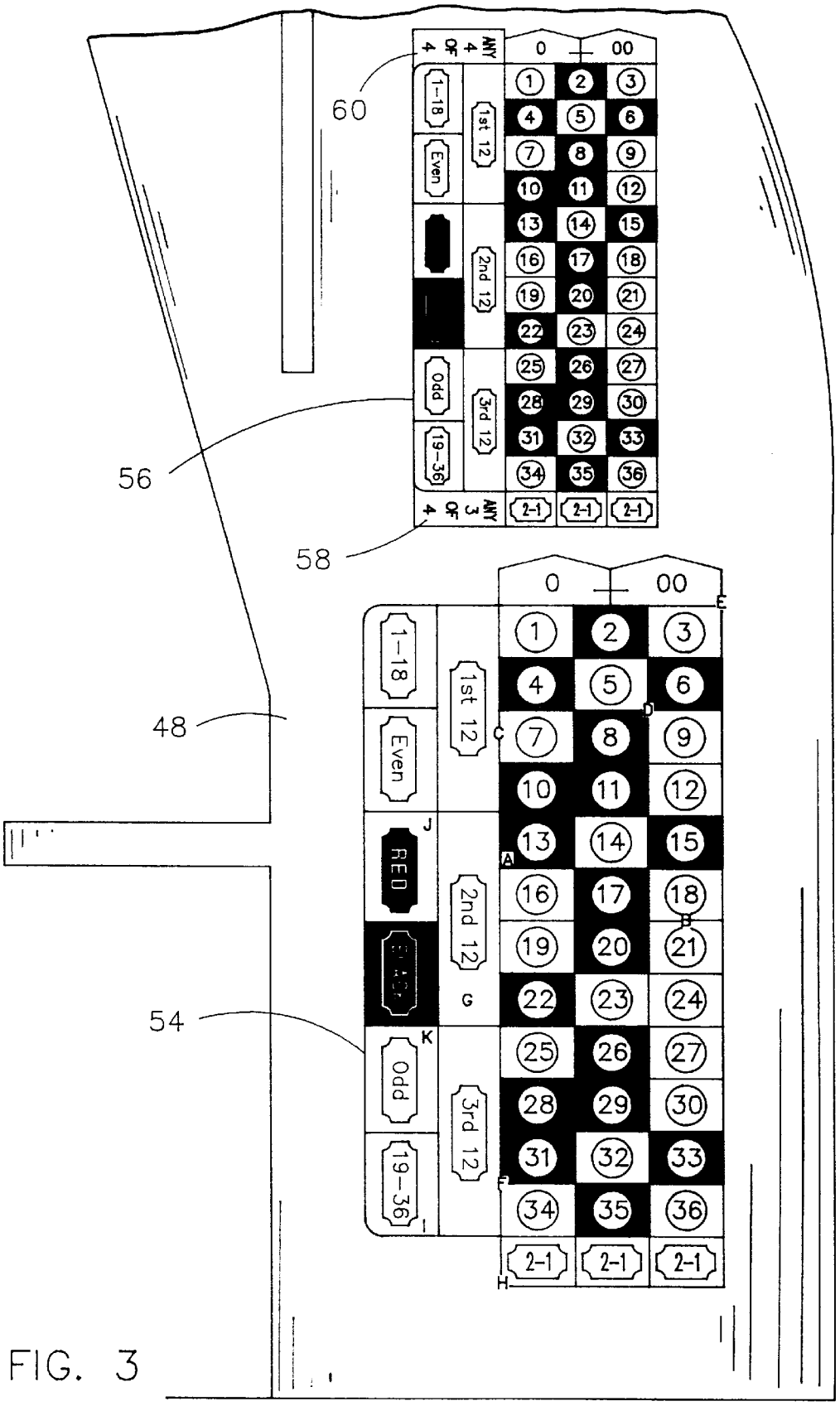
FIG. 3 is an enlarged plan view of one table of the game.

Referring now to FIG. 3, the green table 48 is shown in more detail. Table 48 has an upper and lower playing field 56 and 54, the upper playing field 56 utilized for placing bets on the plurality of balls 26, while lower playing field 54 is utilized to place bets on the single ball 26 which is associated with that particular table. In this case, lower field 54 would be utilized to place a bet on the green ball 26*d*. Lower playing field 54 is arranged in a conventional fashion for American roulette, having two zeros on the wheel. Thus, time player may place any of the following different bets:

| | Name of Bet | Number of Numbers Covered by Bet | Payment Rate |
|---|---|---|---|
| A | Straight | 1 | 35-1 |
| B | Split | 2 | 17-1 |
| C | Street | 3 | 11-1 |
| D | Square | 4 | 8-1 |
| E | Line | 5 | 6-1 |
| F | Line | 6 | 5-1 |
| G | Dozens | 12 | 2-1 |
| H | Columns | 13 | 2-1 |
| I | High or low | 18 | 1-1 |
| J | Black or red | 18 | 1-1 |
| K | Even or odd | 18 | 1-1 |

Sample locations for each of the above-identified bets are marked on the lower table 54 with the letters A, B, C, D, E, F, G, H, I, J, K, respectively. Thus, it can be seen that the roulette game of the present invention may be played in the conventional fashion, placing bets on the ending location of a single ball into one of the pockets 22.

The addition of the upper playing field 56 permits new possibilities previously unknown in a roulette-type game. Upper field 56 is the same as lower field 54, but with the addition of two additional betting boxes 58 and 60. In the preferred embodiment of the invention, four balls are in play, and box 58 permits a bet of any three of the four balls falling within a single pocket. Similarly, betting box 60 envisions a four ball game with the bet covering all four of the balls falling within any single pocket. Obviously, the method of this game is equally applicable on games having either fewer or more balls in play, but with a minimum of two balls in play. In a two ball game, the upper layout would be utilized to cover both balls falling within the range of pockets allowed by the type of bet. Thus, if the bet were "straight up" both balls would have to fall within the same pocket. If the bet were "split" then the two balls would have to fall within one or both of the two pockets covered by the bet. Similarly, in a two ball game, betting box 58 would cover "any one of two" and betting box 60 would cover "any two of two".

In general, in games with "n" balls in play, betting box 58 would cover a bet for "any n-1 of n", while box 60 would cover bets on "any n of n". The estimated payment rate for bets on the upper playing field would be as follows, where 4 balls are used in the game:

| Name of Bet | Payment Rate |
|---|---|
| 4 of 4 straight up | 1,666,667-1 |
| split 4 of 4 | 100,000-1 |
| Any 4 of 4 | 40,000-1 |
| Street 4 of 4 | 20,000-1 |
| Any 3 of 4 | 250-1 |
| Dozens | 80-1 |
| High or Low | 15-1 |
| Black or Red | 15-1 |
| Even or Odd | 15-1 |

In addition, while the preferred embodiment of the invention utilizes a single roulette wheel with a plurality of tracks 38 for each of the balls in play, the method of the invention would work equally as well with a plurality of separate roulette wheels, each wheel having one or more tracks. The excitement in the game is the possibility of betting on a plurality of balls simultaneously, rather than merely on a single ball for each spin of the wheel.

In use, patrons will gather around each of tables 42, 44, 46, and 48, associated with each of the balls 26 to be utilized in the game. Patrons will then place allowable bets on the upper and/or lower playing fields 54 and 56 on their particular table. Croupiers then will put the four balls 26 into motion, one after another, from the lower most track 38*a* to the upper most track 38*d*. Preferably, the balls are placed into motion in a direction counter that of the rotation of the roulette wheel. As each ball loses momentum, it will spiral and bounce downwardly to finally fall within one of the pockets 22 on disk 12. The sensors 52 will detect the presence and location of each ball 26, and display the location on the associated post 50*a*, 50*b*, 50*c*, and 50*d*.

After the simultaneous display of the four numbers, a croupier at each tables will designate the appropriate number on the lower playing field 54, and proceed to remove losing bets and payout winning bets. The process then begins again.

Whereas the invention has been shown and described in connection with the preferred embodiment thereof, many modifications, substitutions and additions may be made which are within the intended broad scope of the appended claims.

I claim:

1. A roulette game apparatus, comprising:

a roulette wheel of the type having a base for supporting a rotatable disk, the base having a generally cylindrical side wall with an inward surface, a plurality of concentric tracks formed on the inward surface of the side wall for temporarily receiving and guiding a ball, a plurality of balls for movement along the tracks and directed by gravity downwardly from the tracks upon a loss of velocity, a disk rotatably mounted on a vertical axis and located below the side wall, a plurality of pockets on the upper surface of the disk with each pocket of the size capable of retaining all of the plurality of balls;

a plurality of tables, each with a horizontal gaming surface, extending outwardly from and proximal to the roulette wheel, one table provided for and associated with each of said plurality of balls;

each said table having a first playing field for placing bets relative to the final resting place of the ball associated with the table; and each said table having a second playing field for placing bets relative to the final resting place of the plurality of balls.

2. The roulette game apparatus of claim 1, wherein the roulette wheel includes four tracks and four balls, and wherein four tables are provided for the balls.

3. The game apparatus of claim 2, wherein the second playing field includes a betting box for placing a wager relative to the final resting place of three of the four balls.

4. The game apparatus of claim 3, wherein said second playing field includes a betting box for placing bets relative to the final resting place of all four of the balls.

5. The game apparatus of claim 2, wherein said second playing field includes a betting box for placing bets relative to the final resting place of all four of the balls.

6. A method for playing a roulette game of the type having a plurality of balls, and at least one roulette wheel with a plurality of numbered pockets for receiving the balls, comprising the steps of:

providing a plurality of tables, with one table associated with each of said plurality of balls, and each table including a first playing field for betting on the ending location of the plurality of balls;

placing a bet, including a plurality of players located at each of the tables placing bets on the first playing field on each table as to the ending location of the balls at the outcome of a spin;

spinning the roulette wheel in a first direction;

propelling all of the balls along tracks on the wheel in a second direction opposite the first direction;

identifying the pockets in which each of the balls resides at the outcome of the spin; and determining winning and losing bets.

7. The method of claim 6, further comprising the steps of:

providing a separate playing field for betting on at least one individual ball of the plurality of balls; and wherein the step of placing a bet includes the step of placing a second bet on said one ball of the plurality of balls, in the separate playing field.

8. The method of claim 6, further comprising the steps of:

providing a separate playing field on each table for betting on one ball of the plurality of balls; and wherein the step of placing a bet includes the step of placing a second bet on said one of said plurality of balls on the separate playing field of each table.

9. The method of claim 8, wherein the number of balls is designated as "n" and wherein the step of providing tables includes providing "n" tables, and wherein the step of betting includes the opportunity to bet on the ending location of at least "n"-1 balls.

* * * * *